US007131390B1

(12) United States Patent
Lachance et al.

(10) Patent No.: US 7,131,390 B1
(45) Date of Patent: Nov. 7, 2006

(54) RESCUE BOAT

(75) Inventors: Jean-François Lachance, 21, av. des Canotiers, Montmagny, Québec (CA) G5V 2B9; François Lachance, Montmagny (CA); Daniel Blais, Montmagny (CA)

(73) Assignee: Jean-François Lachance, Montmagny (CA)

( * ) Notice: Subject to any disclaimer, the term of this patent is extended or adjusted under 35 U.S.C. 154(b) by 0 days.

(21) Appl. No.: 11/228,265

(22) Filed: Sep. 19, 2005

(51) Int. Cl.
*B63C 9/06* (2006.01)
*B63B 3/00* (2006.01)

(52) U.S. Cl. ..... 114/348; 114/359

(58) Field of Classification Search ..... 114/347, 114/348, 357, 358, 359
See application file for complete search history.

(56) References Cited

U.S. PATENT DOCUMENTS 2,328,437 A * 8/1943 Elling ..... 114/348
3,101,489 A * 8/1963 Chance ..... 114/348
3,600,733 A * 8/1971 Lippisch ..... 114/357
4,161,796 A * 7/1979 Kostanecki ..... 114/357

* cited by examiner

*Primary Examiner*—Jesús D. Sotelo
(74) *Attorney, Agent, or Firm*—Ogilvy Renault LLP; Guy J. Houle

(57) ABSTRACT

A rescue boat capable of use on ice, strewn water, water, snow and dragged over rigid surfaces is described. The rescue boat comprises a hull fabricated from a lamination of fiber materials having a specific orientation to provide flexibility for shock absorbing. An inner keel beam is retained along a central longitudinal axis of the hull on an inner surface of the hull. A transom cowling extends across opposed sidewalls of the hull and merges into a transom wall laminated with the hull. One or more transverse seating frames are secured across the opposed sidewalls by connecting brackets and adapted to transfer impact forces with the sidewalls. One or more vertical rigid support posts are secured to the inner keel beam and an associated one of the one or more transverse seating frames for transmitting vertical impact forces between the inner keel beam and the one or more transverse seating frames.

20 Claims, 4 Drawing Sheets

RESCUE BOAT

TECHNICAL FIELD

The present invention relates to a small rescue boat capable of use on ice flows, water and dragged on land surfaces by rescue persons and capable of absorbing impact forces while maintaining its rigidity.

BACKGROUND ART

Very little innovations have been made to develop a small rescue boat which is capable of being used on water and ice and other surfaces and wherein the craft is displaced by two or more rescue persons capable of dragging the small craft over ice flows and land surfaces as well as on bodies of water. The craft, although small, must resist to the wear-and-tear of such environment and be capable of supporting ideally five people whereby a rescued person can be carried by the small water craft. Large ice canoes exist for racing over bodies of water strewed with broken ice and open water but these are constructed of wood ideally using cedar planks which nowadays is covered with a polyester material such as fiberglass. These canoes have a length of over twenty feet and a width of sixty-five inches and capable of accommodating 5 people. In the early Nineteen Nineties such canoes were modified using composite fiberglass sheeting material impregnated with polyester resins but these structures were very rigid and were therefore subjected to damage when impacted by heavy rigid objects such as large pieces of ice. By the mid nineteen nineties these canoes were modified wherein the length thereof was increased to 28 feet and the width up to 50 inches whereby to increase the structural rigidity of the canoes but this created another problem in that the canoe was very heavy and was not flexible to absorb impact forces without damage thereto.

With the advent of Kevlar material a solution appeared to be promising as such material was very rigid. However, it had too much flexibility for this type of water craft and additional reinforcement was therefore necessary and the weight thereof had to be increased. Although these canoes were used mainly for racing over ice strewn waters or transporting material over such waters they were not reliable for use as a rescue craft due to its lack of flexibility and rigidity and also of its heavy weight.

However, the experience acquired in the construction of such canoes led to the development of the rescue boat of the present invention and one which would be capable of resisting impact, one which would have flexibility, durability and be of light weight so that it could be easily displaced by two or more rescue persons and accommodate up to five persons.

SUMMARY OF INVENTION

It is therefore a feature of the present invention to provide a rescue boat which is capable of use on ice and water and which has the desired characteristics as above-mentioned.

According to the above feature, from a broad aspect, the present invention provides a rescue boat comprised of a hull fabricated from a lamination of fiber materials having a specific orientation to provide flexibility for shock absorbing. An inner keel beam is freely retained along a central longitudinal axis of the hull on an inner surface of the hull. A transom cowling extends across opposed flexible sidewalls of the hull and connects to a transom wall. One or more transverse seating frames are secured across the opposed flexible sidewalls by connecting brackets and adapted to transfer impact forces with the sidewalls. One or more vertical rigid support posts are secured to the inner keel beam and an associated one of the one or more transverse seating frames. The rigid vertical support posts are secured to the inner keel beam and retain the inner keel beam over an inner surface of the hull along the central longitudinal axis thereof to receive vertical impact forces from a bottom section of the hull to transfer the vertical impact forces to the one or more transverse seating frames and into the flexible sidewalls to absorb the vertical impact forces.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
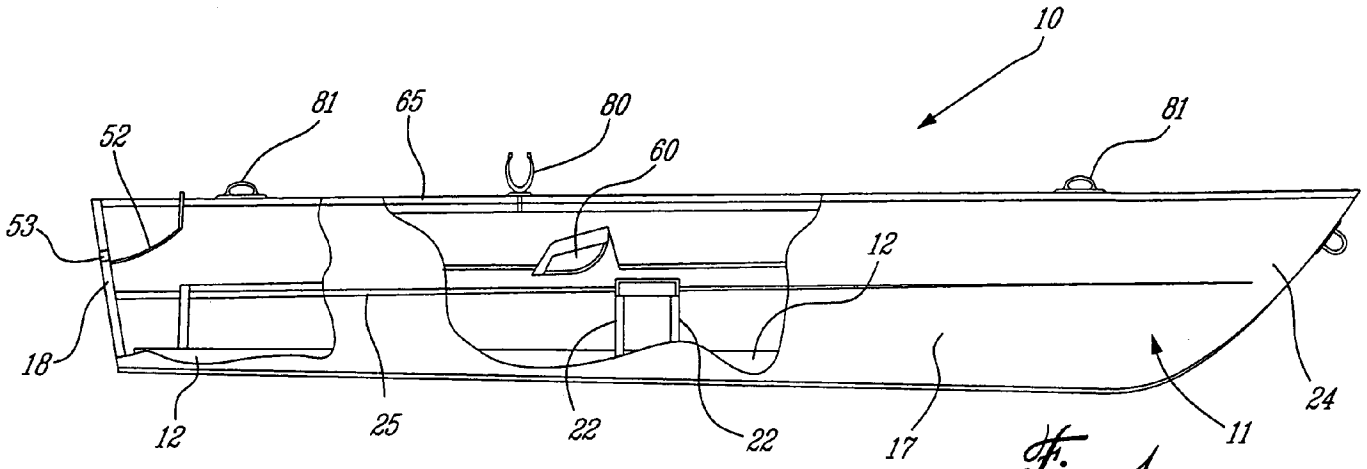
FIG. 1 is a side view, partly fragmented, of a rescue boat constructed in accordance with the present invention and capable of use on ice, strewn water and water.
Figure 2:
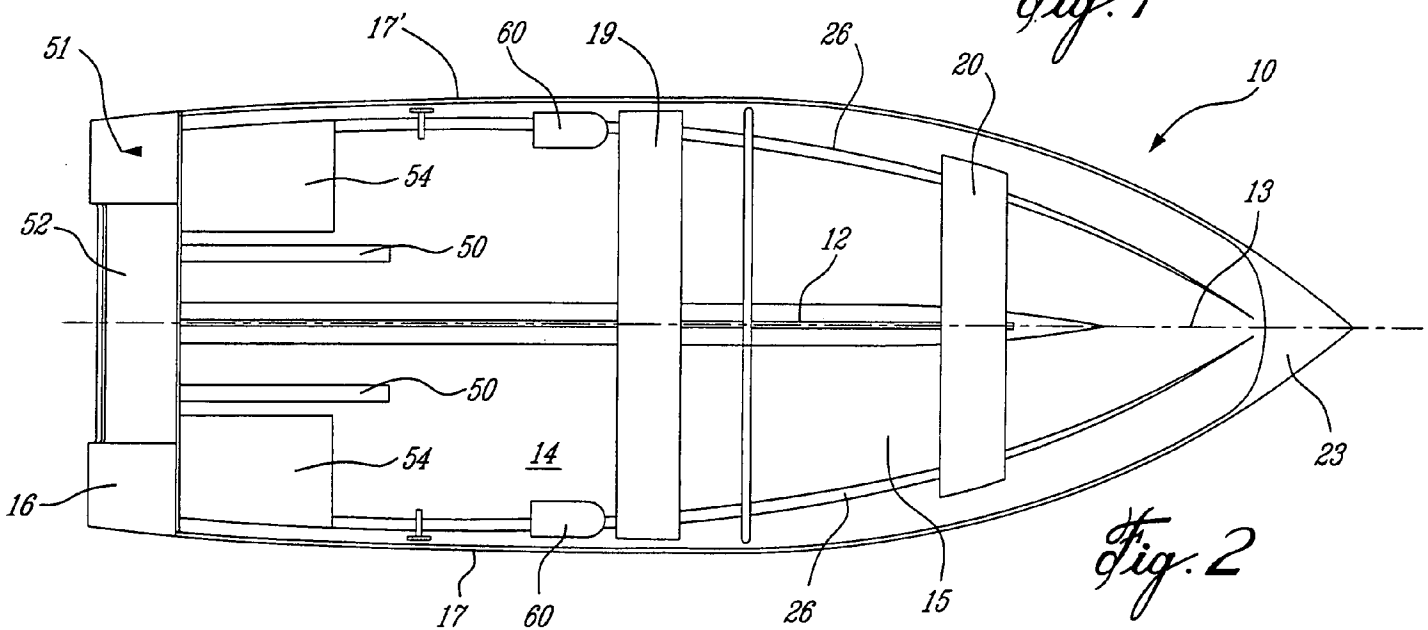
FIG. 2 is top view of FIG. 1.
Figure 3:
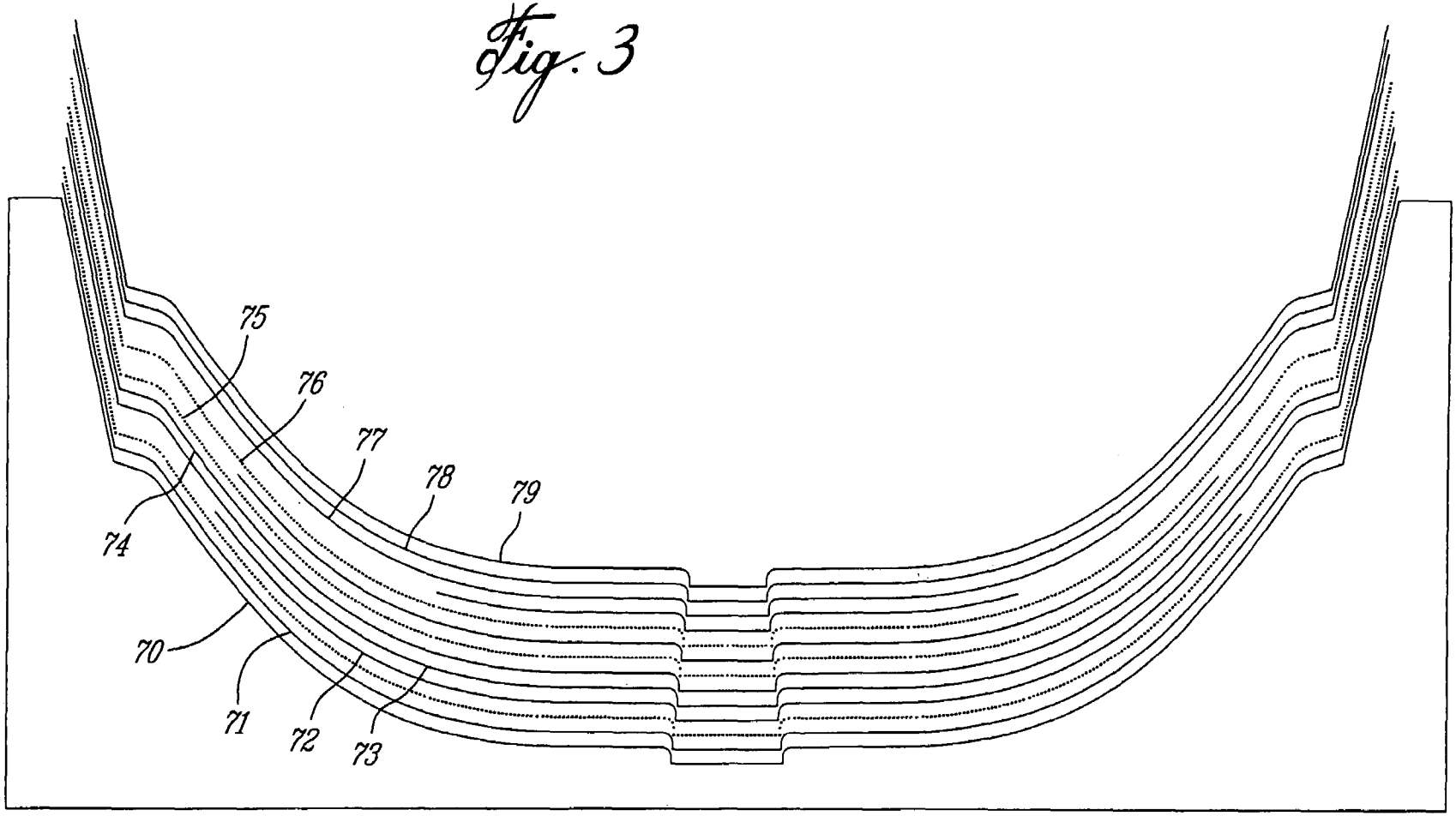
FIG. 3 is an exploded section view of the hull showing the disposition of the various fabric layers which are laminated and bonded together to form the hull.

Referring now to the drawings and more particularly to FIGS. 1 and 2 there is shown generally at 10 a rescue boat constructed in accordance with the present invention. The rescue boat comprises a hull 11 fabricated from a lamination of fiber materials, as illustrated in FIG. 3, and which will be described later. The fiber materials are oriented in a specific manner whereby to provide flexibility to the hull and strength to absorb shocks.

An inner keel beam 12 is retained along a central longitudinal axis 13 of the hull 11 on an inner surface 14 of the bottom wall 15 of the hull.

A molded transom cowling 16 extends across opposed sidewalls 17 and 17' of the hull 11 and merges into a transom wall 18. The transom wall 18 is fabricated from wood products and preferably is a marine plywood transom wherein the lamination of the fiberglass material has good bonding properties therewith. Accordingly, this transom wall is secured laminated to the sidewalls of the hull.

One or more transverse seating frames 19 and 20, shown in FIG. 2, are secured across the opposed sidewalls 17 and 17' by connecting brackets 21 (see FIG. 5) the construction of which will be described later. The seating frames with their connecting brackets are adapted to transfer impact forces with the flexible sidewalls 17 and 17' and to distribute vertical forces through its interconnection with the inner keel beam 12. These seating frames 19 and 20 are secured to the inner keel beam 12 by support posts 22 as will be described later. Accordingly, any impact force on the bottom wall 15 of the hull will be transfered into the seating frames 19 via the inner keel beam and the connecting posts 22 whereby the entire hull will flex to absorb these impact forces and prevent damage to the hull of the rescue boat.

Additionally, and as shown in FIG. 2 a bow bridge 23 is molded from fiberglass material and is secured in the bow 24 of the boat 10 and overlaps the top portion of the sidewalls 17 an 17' to interconnect the sidewalls to increase the strength of the bow 24 of the boat to resist to frontal impact forces on the bow by floating objects or stationary objects if the boat is dragged over land surfaces or ice strewn waters.

As can be seen from FIGS. 1 and 2 the hull 11 is further molded with a longitudinal draft ridge 25 to provide lateral rigidity of the sidewalls 17 and 17'. This ridge also defines a support inner seating ridge 26 over which the transverse seating frames 19 and 20 are connected and supported.

Figure 4:
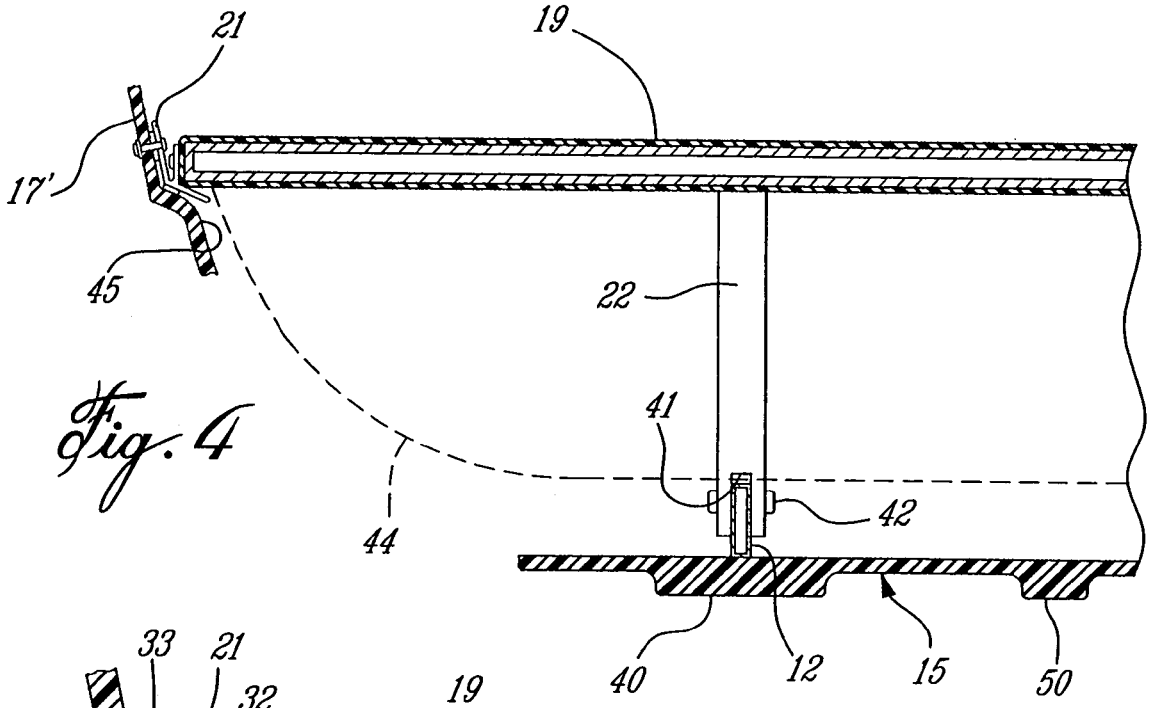
FIG. 4 is a fragmented section view showing the relationship between the hull sidewalls, the seating frame and its connection to the inner keel beam.
Figure 5:
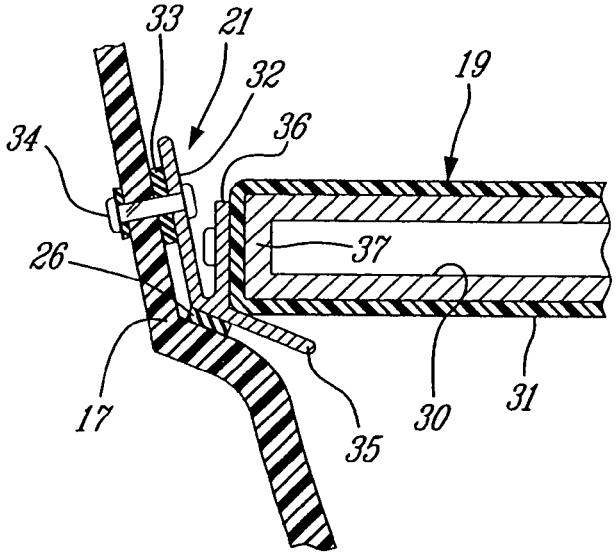
FIG. 5 is an enlarged view showing the connection between the sidewall of the hull and the end wall of the seating frame.

With further reference now to FIGS. 4 and 5 there is shown the construction of the transverse seating frames 19 and 20. As shown in FIG. 2 a main one of the seating frames, namely frame 19, is retained in a mid-hull area of the boat. A second one of the seating frames, namely frame 20, is secured intermediate the bow 24 of the hull 11 and the seating frame 19. As shown in FIG. 5, the seating frame 19 is comprised of a hollow aluminum frame 30 about which a polymeric material 31 is molded. The connecting bracket 21 is constructed of flexible steel material, having a memory, with one being connected at opposed ends of the seating frame 19 and are secured to the opposed sidewalls 17 and 17'. The bracket 21 has a connecting flange 32 extending at an angle coincident with the angle of the sidewall of the hull and is provided with holes for securement to the sidewall above the longitudinal draft ridge 25. A rubber gasket 33 may be interposed between the inner surface of the sidewall 17 and the connecting flange 32. Suitable fasteners 34 with waterproofing washers provide the interconnection. The bracket 21 further has a support flange 35 which is also angulated to sit on the inner seating ridge 26 to provide support not to strain the bracket. A connecting flange 36 connects to the end wall 37 of the seating frame 19.

As shown in FIG. 4 the inner keel beam 12 is a hollow aluminum beam which provides for light weight and rigidity and is retained in position on the bottom wall 15 of the hull by the vertical support post 22. The inner keel beam 12 is aligned with a central keel 40 molded in the hull bottom wall and projecting centrally and longitudinally there under. This projecting central keel 40 provides for ground support and is subjected to wear-and-tear and impact forces thereon which are distributed along the inner keel beam 12 and upwardly through the support post 22 and into the seating frames 19 and 20 and hull as the seating frames interconnect to the sidewalls 17 and 17' of the hull to provide further shock absorption through the connecting brackets 21. As herein shown the vertical posts 22 have a channel bottom end section 41 whereby to receive therein a top portion of the inner keel beam 12 and are secured thereto by a fastener 42.

Figure 6:
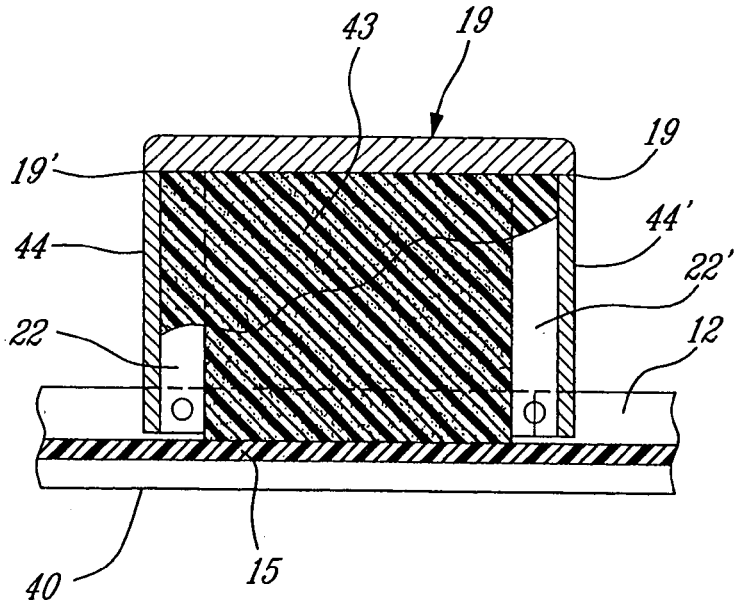
FIG. 6 is a section view of the seating frame and a portion of the inner keel beam and hull.

As shown in FIG. 6 there are two support posts 22 and 22' secured to opposed sides of the transverse seating frames 19 and 20 and therefore there is a rigid interconnection between the seating frame 19 and the inner keel beam 12. Floatation foam material 43 is also disposed under seating frame and between opposed sidewalls 44 and 44' of the seating frame. These sidewalls 44 and 44' are secured to opposed longitudinal side edges 19' of the seating frame 19 and extend spaced from the hull inner surfaces 45 as illustrated in FIG. 4, to provide a clearance space therewith. The floatation material 43 is retained in a space under the seating frame and between the sidewalls 44 and 44'.

As shown in FIG. 4 there is also molded with the bottom wall 15 secondary stern keels 50 the position of which is better illustrated in FIG. 2 with one disposed on the respective side of the central keel 40. These stern keels extend in the stern section only of the hull to reinforce the stern section and reduce sliding friction between the hull and a rigid support surface on which the hull is displaced. These stern keels also provide added stability on water and also support stability when resting on a rigid surface preventing it from tilting onto the hull which is more fragile than the keels.

Figure 7:
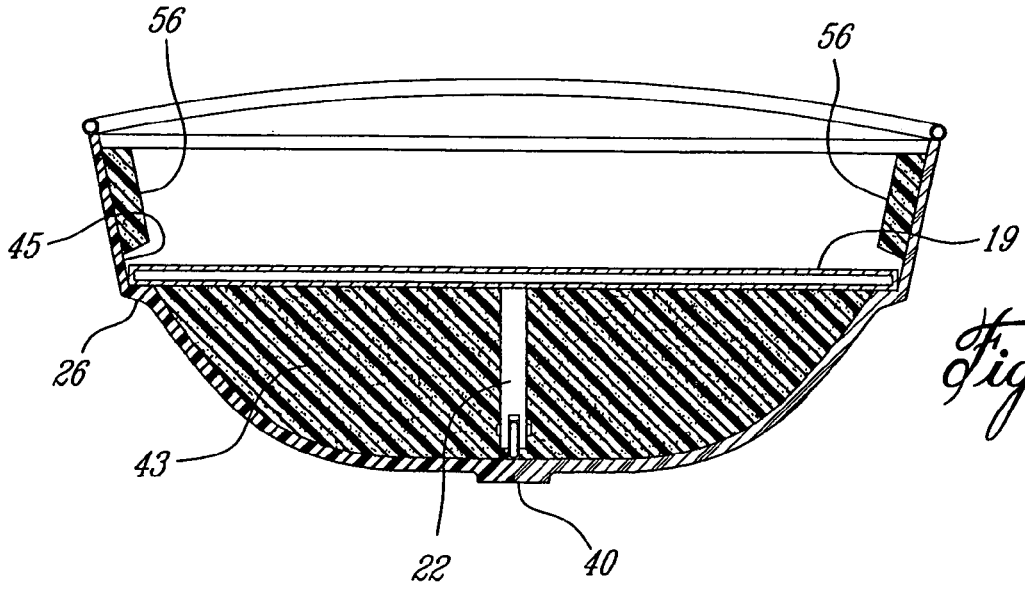
FIG. 7 is a cross-section view of the hull showing the disposition of the floatation material.
Figure 8:
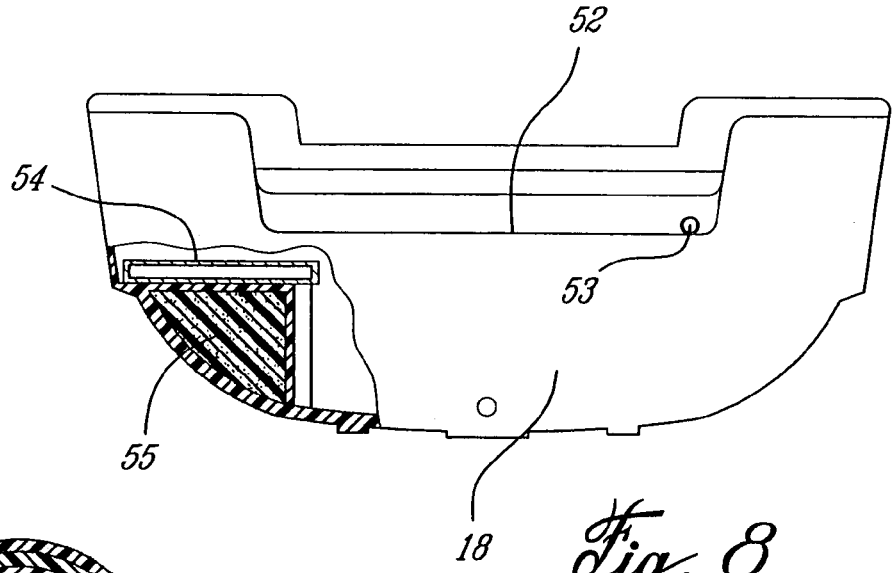
FIG. 8 is a rear view of the rescue boat and partly fragmented to show the construction of the transom cowling, the transom wall and the stern seats with the floatation material secured thereunder.

With reference now to FIGS. 1 to 8 there is shown the construction of a transom cowling 51 secured across sidewalls 17 and 17' in the stern portion of the boat. The transom cowling 51 has a top section 52 provided with a drain hole 53 to evacuate water from the tub section. This transom cowling provides for transverse rigidity and resistance to torsion as well as protecting the rear portion of the hull from incoming waves. A motor may be secured to the transom wall 18. Stern seats 54 are also provided on opposed sides of the stern area of the hull, forwardly of the transom cowling 51 and a rigid floating material 55 is secured under each of the stern seats to provide added stability. As shown in FIG. 7 a rigid floatation band 56 is adhered to the inner surface 45 of the sidewalls above the inner seating ridge 26.

Another feature of the rescue boat 10 of the present invention resides in that knee support harnesses 60 are secured over the inner surface of the sidewall and in an upper area thereof behind the central seating frame 19. These knee support harnesses 60 provide for a user person to position a leg inside the hull with the knee lodged into this support harness while pushing the boat with its other leg outside the sidewall to propel the boat over ice or other support surfaces such as snow covered surfaces. This also provides added security to the user person where most of his body is located inside the boat while propelling it with his outer leg.

Figure 9:
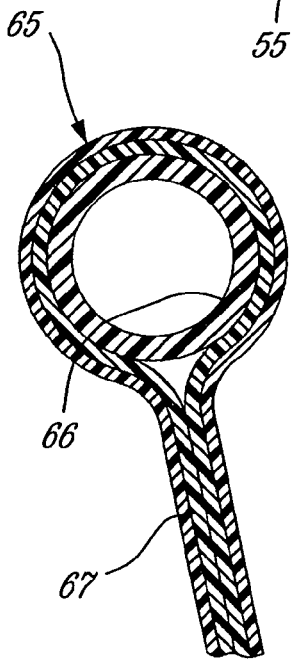
FIG. 9 is a section view showing the construction of the rub rail molded along the top end of the sidewalls of the hull.

Referring now to FIG. 9 there is shown the construction of a protective rub rail 65 which is molded along a top end of the sidewalls 17 and 17'. This rub rail 65 is comprised of an inner hollow plastic tube 66 of polymeric material, such as the plastic tubes used to run electrical conduits therein, and which is capable of flexing without deformation. This flexible inner plastic tube is retained along the top end of the sidewalls by a lamination of the fiber materials 67, some of which form the laminate sidewalls of the hull.

Referring now to FIG. 3 there will be described the lamination of the fiber materials which form the hull with the exception of the stern wall 18 as previously described. The hull is fabricated from a lamination of fiber materials which comprise a plurality of transversely oriented fiberglass and Kevlar sheets bonded together by a resin having an elastic memory of about 6% and permitting the lamination to achieve a desirable flexibility and rigidity. This lamination of fiber materials is shown in FIG. 3 in an exploded form to facilitate the description thereof. The hull is fabricated from fiberglass sheets which are bi-axial woven sheets of about 11.5 ounces and 15 ounces and fabricated by J.B. Martin. Kevlar sheets are also intermingled with these fiberglass sheets.

As illustrated in FIG. 3 the lamination is comprised of the following disposition of fiber sheet materials and as seen from the outer surface of the hull to the inner surface thereof.

When the lamination is set, the outer surface is coated with a gel coat 70. The lamination comprises two sheets of transversely oriented bi-axial fiberglass, positioned exteriorly of the hull, with the outer sheet 71 being oriented with its fibers extending transversely of the hull longitudinal axis 13, as shown in FIG. 2. These two sheets 71 and 72 are followed by two transverse sheets of Kevlar. These two transverse sheets are followed by an additional two transverse sheets of Kevlar 73 and 74 and a longitudinal sheet of bi-axial fiberglass 75. Above this bi-axial fiberglass sheet 75 there is disposed a longitudinal sheet of Kevlar 76 followed by a transverse sheet of Kevlar 77. An interior surfaces mat 78 covers the top Kevlar sheet and a gel coat 79 can then be applied over the mat after setting. All of these sheets are disposed in a mold under vacuum, as is well known in the art, and laminated together with the resin material as previously described. Such autoclave molding causes the resin to be fully distributed throughout the layers of reinforcing fabrics. As also illustrated in FIG. 3 other reinforcing fiber sheets are interposed between the main sheets as above described with some of these sheets extending over the entire surface of the hull and other of the sheets being formed of two sheet sections overlapped at least over the bottom floor area of the hull where the central keel and the secondary stern keels are molded whereby to reinforce the floor area.

The rescue boat as above-described provides for a rescue boat which has a length of about 17 feet and a width of 6 feet. It has a dept of 2 feet 4 inches and weighs approximately 350 lbs. It is capable of being propelled on water with an outboard motor of 15 to 30 horse power and is provided with oars which are fitted in the oar locks 80 as shown in FIG. 1. Handles 81 are also secured to the rub rails 65 of the boat to facilitate the transportation of the boat. The boat has a capacity of 5 adult persons and is fully resistant to impact forces applied thereto from any direction.

It is within the ambit of the present invention to cover any obvious modifications of the preferred embodiment described herein provided such modifications fall within the scope of the appended claims.

The invention claimed is:

1. A rescue boat comprising a hull fabricated from a lamination of fiber materials having a specific orientation to provide flexibility for shock absorbing, an inner keel beam freely retained along a central longitudinal axis of said hull on an inner surface of said hull, a transom cowling extending across opposed flexible sidewalls of said hull and connects to a transom wall, one or more transverse seating frames secured across said opposed flexible sidewalls by connecting brackets and adapted to transfer impact forces with said sidewalls, and one or more vertical rigid support posts secured to said inner keel beam and an associated one of said one or more transverse seating frames, said rigid vertical support posts being secured to said inner keel beam and retaining said inner keel beam over said inner surface of said hull along said central longitudinal axis to receive vertical impact forces from a bottom section of said keel to transfer said vertical impact forces to said one or more transverse seating frames and into said flexible sidewalls which flex to absorb said vertical impact forces.

2. A rescue boat as claimed in claim 1 wherein there is further provided a bow bridge secured in a bow of said boat to interconnect said sidewalls to increase the strength thereof to resist to impact forces.

3. A rescue boat as claimed in claim 1 wherein there are two of said transverse seating frames, a main one of said seating frames being retained in a mid-hull area of said boat and a second one of said seating frames being retained intermediate a bow of said hull and said main one of said seating frames.

4. A rescue boat as claimed in claim 3 wherein said opposed sidewalls are molded with a longitudinal draft ridge to provide lateral rigidity to said sidewalls and to provide a support inner seating ridge for said transverse seating frames.

5. A rescue boat as claimed in claim 4 wherein said connecting brackets are flexible steel brackets having a memory and secured to opposed end walls of said seating frames, said brackets each having a connecting flange adapted to be secured to said sidewalls of said hull above said longitudinal draft ridge formed in said sidewalls, a support flange for seating on said inner seating ridge and a connecting flange for securement to said end walls of said seating frames.

6. A rescue boat as claimed in claim 5 wherein there is further provided secondary stern keels molded in said hull and disposed one on a respective side of said central keel in a stern section of said boat to reinforce said stern section and reduce sliding friction between said hull and a rigid support surface on which said hull is displaced, said stern keels also providing support stability of said hull on said rigid surface.

7. A rescue boat as claimed in claim 4 wherein there is further provided a rigid floatation band adhered to an inner surface of each said sidewalls above said inner seating ridge to provide added floatability.

8. A rescue boat as claimed in claim 1 wherein said inner keel beam is a hollow rectangular light weight metal beam retained in position by said one or more vertical rigid support posts and aligned over a central keel molded in said hull and projecting thereunder.

9. A rescue boat as claimed in claim 1 wherein said transom cowling is a molded transom cowling which is laminated with at least a portion of said hull.

10. A rescue boat as claimed in claim 1 wherein there is further provided a knee support harness secured to an inner surface of said sidewalls in an upper area thereof to permit a user person to position a leg inside said hull while pushing said boat with its other leg outside said sidewall to propel said boat over ice or other support surfaces.

11. A rescue boat as claimed in claim 1 wherein there is further provided a stern seat on opposed sides of a stern area of said hull forwardly of said transom cowling, and a rigid floating material secured under each said stern seat to provide added stability on water.

12. A rescue boat as claimed in claim 1 wherein there are two of said vertical rigid support posts secured to each said one or more transverse seating frames, one of said support posts being secured adjacent a respective one of opposed longitudinal side edges of said seating frame, and a seating frame sidewall secured to each said opposed longitudinal side edges and extending spaced from said hull inner surfaces to provide a clearance space therewith, and a floatation material retained in a space under said seating frame and between said sidewalls.

13. A rescue boat as claimed in claim 1 wherein said transom wall is constructed of a marine wood product and laminated with said hull.

14. A rescue boat as claimed in claim 1 wherein a rub rail is molded along a top end of said sidewalls, said rub rail comprising a hollow plastic tube of polymeric material capable of flexing without deformation and retained along said top end by said lamination of fiber materials.

15. A rescue boat as claimed in claim 1 wherein said lamination of fiber materials comprises a plurality of transversely oriented fiberglass and Kevlar sheets bonded together by a resin having an elastic memory of about 6%, and an outer gel coat on said hull to provide an outer slippery surface.

16. A rescue boat as claimed in claim 15 wherein said fiberglass sheets are bi-axial woven sheets of about 11.5 ounces and 15 ounces.

17. A rescue boat as claimed in claim 15 wherein said lamination is constituted by the following disposition of said fiber sheet materials from an outer surface of said hull to said inner surface thereof, said disposition comprising two sheets of transversely oriented bi-axial fiberglass sheets with an outer sheet thereof oriented transversely, followed by two transverse sheets of Kevlar, a longitudinal sheet of bi-axial fiberglass, a longitudinal sheet of Kevlar followed by a transverse sheet of Kevlar, and an interior surface mat of ¾ ounces.

18. A rescue boat as claimed in claim 17 wherein a gel coat is applied to said interior surface mat.

19. A rescue boat as claimed in claim 17 wherein some of said sheets of fiberglass and Kevlar materials extend over the entire surface of said hull and other of said sheets are formed of two sheet sections overlapped at least over a bottom floor area of said hull where a central keel and secondary stern keels are molded to reinforce said floor area.

20. A rescue boat as claimed in claim 1 wherein said rescue boat has a weight of about 350 lbs. and a capacity of five people.

* * * * *